US009200789B2

(12) United States Patent
Yang

(10) Patent No.: US 9,200,789 B2
(45) Date of Patent: Dec. 1, 2015

(54) MAGNETIC PIVOT CONNECTOR STRUCTURE FOR LAMP

(71) Applicant: Chih-Te Yang, New Taipei (TW)

(72) Inventor: Chih-Te Yang, New Taipei (TW)

( * ) Notice: Subject to any disclaimer, the term of this patent is extended or adjusted under 35 U.S.C. 154(b) by 20 days.

(21) Appl. No.: 14/272,731

(22) Filed: May 8, 2014

(65) Prior Publication Data

US 2014/0334166 A1 Nov. 13, 2014

(30) Foreign Application Priority Data

May 8, 2013 (TW) ..... 102208483 U

(51) Int. Cl.

| | |
|---|---|
| ***F21V 21/00*** | (2006.01) |
| ***F21V 21/096*** | (2006.01) |
| ***F21S 8/06*** | (2006.01) |
| ***F21V 21/12*** | (2006.01) |
| ***F21V 23/06*** | (2006.01) |
| *F21V 21/06* | (2006.01) |

(52) U.S. Cl.

CPC ..... *F21V 21/096* (2013.01); *F21S 8/065* (2013.01); *F21V 21/12* (2013.01); *F21V 23/06* (2013.01); *F21V 21/06* (2013.01)

(58) Field of Classification Search

CPC ..... F21V 21/06; F21V 21/096; F21V 21/12; F21V 23/06; F21S 8/065

USPC ..... 362/398, 457, 647, 649

See application file for complete search history.

(56) References Cited

U.S. PATENT DOCUMENTS 3,917,940 A * 11/1975 Duddy ..... 362/398

* cited by examiner

*Primary Examiner* — Jason Moon Han

(74) *Attorney, Agent, or Firm* — Rosenberg, Klein & Lee

(57) ABSTRACT

A magnetic pivot connector structure is provided. The structure comprises a magnetic socket and a magnetic plug. The magnetic socket includes negative and positive grooves at the center. A magnet is disposed on one side of the positive and negative grooves. The positive and negative grooves are connected electrically to a first member. The magnetic plug comprises positive and negative shafts disposed aside. An iron member is disposed on one side of the positive and negative shafts. The positive and negative shafts are connected electrically to a second member. When the magnetic plug is connected electrically to the magnetic socket. The magnet attracts the iron member, which connects electrically the first and second members. Then the positive shaft is used as the axle center and the negative shaft rotates around the negative groove. Thereby, the first and second members are connected pivotally and rotate with respect to each other.

8 Claims, 10 Drawing Sheets

MAGNETIC PIVOT CONNECTOR STRUCTURE FOR LAMP

FIELD OF THE INVENTION

The present invention relates generally to a pivot connector structure for lamp, and particular to a magnetic pivot connector structure that attracts the two end devices to be connected pivotally using magnetism, connects the two end devices, and enables rotation of the two end devices with respect to each other.

BACKGROUND OF THE INVENTION

Technologies progress with each passing day. Instead of asking for adequacy for use as before, people become more demanding on the performance of various products. Following the humane thinking model, lamps are always one of the important inventions in the history. Up to date, various types of lighting equipment have ever introduced. The invention of lighting equipment improves the inconvenience at dim nights for people. In order to reinforce the light in the circumstances of weaker lighting, farther sites, or blocked light, table lamps are invented for disposing aside.

Most people stay at home in their leisure time engaged in watching TV or using computers. Indoor activities have occupied most of modern people's time, deteriorating and degenerating people's vision in the long run. Table lamps can emit light from a nearby site. Thereby, harms such as vision degeneration and fatigue or discomfort in eyes caused by insufficient light during reading, performing paperwork, or using computers. Illumination influences greatly on vision. Accordingly, providing good and proper illumination by a table lamp is the key to improving indoor brightness. Nowadays, table lamps are extensively applied to various scenarios and become a very popular light-emitting device. For example, table lamps are applied to general homes, companies, research facilities, government institutions, and other scenarios.

The current table lamps can be categorized into the fixed, flexible, and cantilever types. The lamp head of a fixed-type table lamp is fixed on a lamp arm and cannot be changed significantly. For a flexible-type table lamp, a soft tube is disposed between the lamp head and the lamp stand. By using the flexible property of the soft tube, a user can adjust the direction and the angle of the lamp head. Besides, for a cantilever table lamp, a lamp arm is disposed between the lamp head and the lamp stand. Both ends of the lamp arm are connected pivotally to the lamp head and the lamp stand, respectively. Thereby, a user can pull the lamp arm and move the lamp head horizontally or vertically to the location requiring illumination depending on his needs in work.

The table lamp technology according to the prior art adopts an integral design, which occupies more space. In addition, when a user operates on the desktop, he may need a light source from different angles or according to the user's sensitivity and requirement in comfort to the light source. Generally, table lamps include an adjustable lamp arm for height and illumination angle, so that the light source can be provided according to the user's required height and angle. Although the integral design can achieve the same result, the height and angle cannot be adjusted at will. Owing to the integral design, the adjustable angles and heights are limited. Moreover, while storing, the integral design constrains the possibility of shrinking further; because of the integral design, some fixed volume is unavoidable. Besides, the variations in the types of lamps are also limited. It is difficult to fully utilize the lamp according to the application location and time. Thereby, it has become a common objective to provide a table lamp structure, which includes varied possibilities in adjusting the height of the frame structure, the angle of illumination, and the brightness. Furthermore, the lamp can be stored with ease without occupying too much zoom.

Accordingly, the present invention provides a magnetic pivot connector structure for improving the lamp structure according to the prior art. The lamp according to the prior art is an integral design, which limits adjustment in height and illumination direction. According to the present invention, a plurality of lamp frames can be added by using the magnetic pivot connector, endowing table lamps with varieties. Lamps having this pivot connector can rotate by 360 degrees for adjusting to the required angle for illumination. Furthermore, disassembling and assembling can be done with ease by using the magnetic pivot connector. It brings convenience for storage by occupying little space. Thereby, the present invention overcomes the drawbacks according to the prior art as described above. The magnetic pivot connector is used for pivot connection. By using the pivot structure, a plurality of lamp frames can be added for adjusting the height. By applying it to the lamp head base, the angle of the lamp head base can be adjusted and the magnetic pivot connector can be used for electrical connection. Besides, by disposing a plurality of magnetic connectors at the principal part of a lamp, users can adjust the number of the lamp heads to be used according to their needs. All they need to do is to connect the lamp head having the magnetic pivot connector magnetically.

SUMMARY

An objective of the present invention is to provide a magnetic pivot connector for lamp. The magnetic pivot connector is connected pivotally between a first member and a second member and enables the first member and second member to establish electrical connection.

Another objective of the present invention is to provide a magnetic pivot connector for lamp. The magnetic pivot connector is connected pivotally between a lamp stand and a lamp arm for facilitating rotating the angle and position of the lamp stand.

Still another objective of the present invention is to provide a magnetic pivot connector for lamp. The magnetic pivot connector is connected pivotally among a plurality of lamp arms for facilitating increasing the height of the lamp.

A further objective of the present invention is to provide a magnetic pivot connector for lamp. The magnetic pivot connector is connected pivotally between a lamp head base and a lamp arm for facilitating adjusting the angle of the lamp head base.

A still further objective of the present invention is to provide a magnetic pivot connector for lamp. The magnetic pivot connector is connected pivotally between a bulb and a lamp head base for facilitating varying the number of bulbs and thus facilitating using and saving electrical power.

In order to achieve the objectives and efficacies described above, the present invention provides a magnetic pivot connector structure, which mainly comprises a magnetic socket and a magnetic plug. The magnetic socket includes a negative groove and a positive groove at the center. A first insulation layer is disposed between the positive groove and the negative groove. A magnet is disposed on one side of the positive and negative grooves. The positive and negative grooves are connected electrically to a first member. The magnetic plug comprises a positive shaft and a negative shaft disposed aside. A second insulation layer is disposed between the positive and negative shafts. An iron member is disposed on one side of the positive and negative shafts. The positive and negative shafts are connected electrically to a second member. When the positive shaft is inserted into and connected electrically to the positive groove and the negative shaft is inserted into and connected electrically to the negative groove, the magnet attracts the iron member, which connects electrically the first and second members.

The magnetic socket and the magnetic plug are connected electrically between the first member and the second member. By using the positive shaft as the axle center, the negative shaft rotates around the negative groove, making the first member and the second member connected pivotally and rotating with respect to each other. When the first member is a lamp arm and the second member is a lamp stand, the disposal of the lamp stand will be flexible. When the first member is a lamp arm and the second member is a lamp arm, it is convenient to add a plurality of third lamp arms for increasing the height the lamp. Hence, the lamp can used as a table lamps or a floor lamp. When the first member is a bulb socket and the second member is a lamp arm, it is convenient to adjust the angle of the bulb socket for better illumination. When the first member is a bulb and the second member is a lamp socket, the number of bulbs can be altered with ease for saving power.

DETAILED DESCRIPTION

In order to make the structure and characteristics as well as the effectiveness of the present invention to be further understood and recognized, the detailed description of the present invention is provided as follows along with embodiments and accompanying figures.

The lamp technology according to the prior art adopts an integral design, which limits the operational range and space while adjusting the height and illumination direction of table lamps. In addition, the integral design is disadvantageous to storage. Thereby, the present invention improves the integral structure and provides a pivot connector structure facilitating disassembling and assembling as well as angle adjustment. Hence, the magnetic pivot connector for lamp according to the present invention is an invention with novelty and nonobviousness.

Figure 1A:
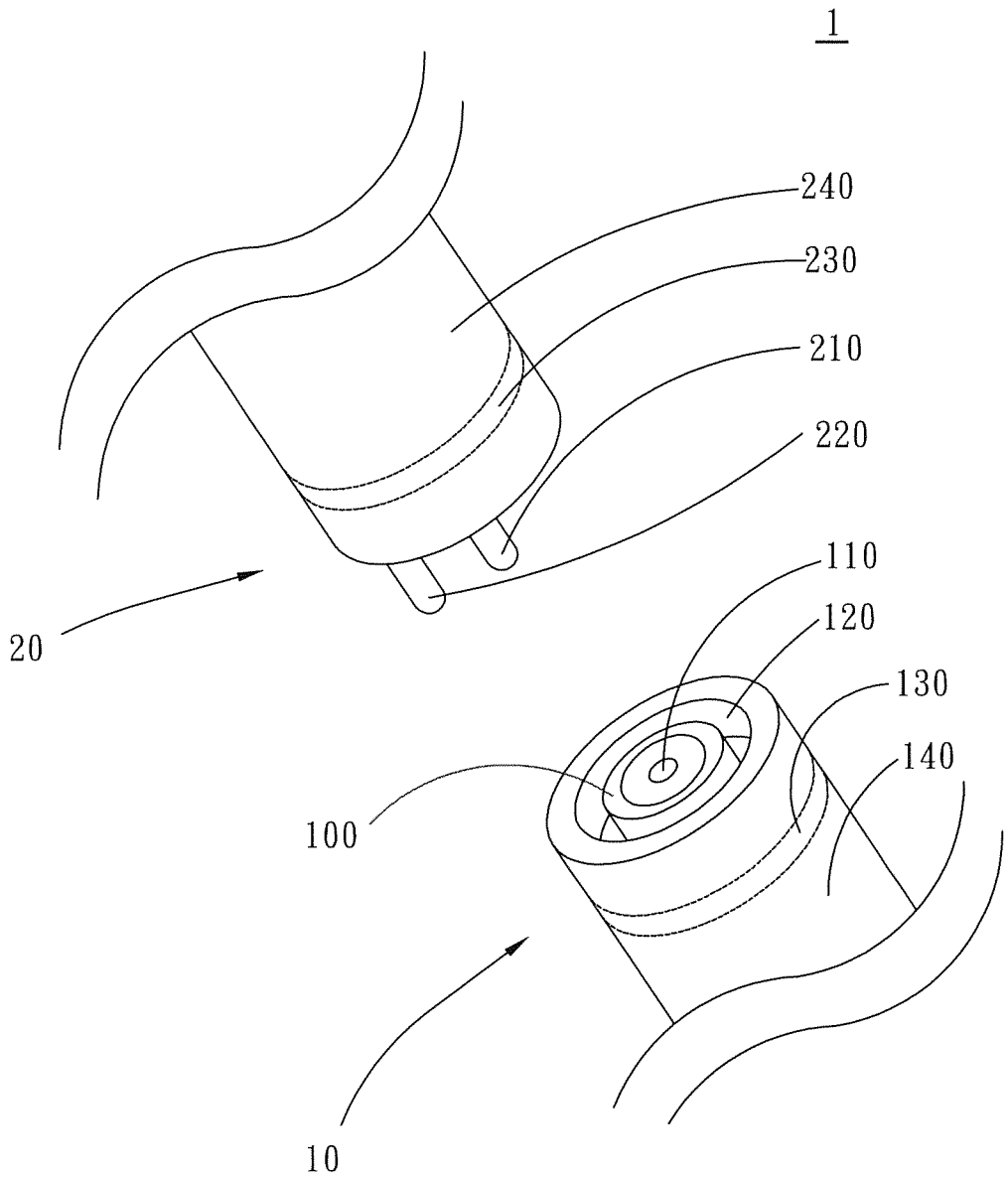
FIG. 1A shows a three-dimensional structural schematic diagram of the magnetic socket according to the present invention.
Figure 1B:
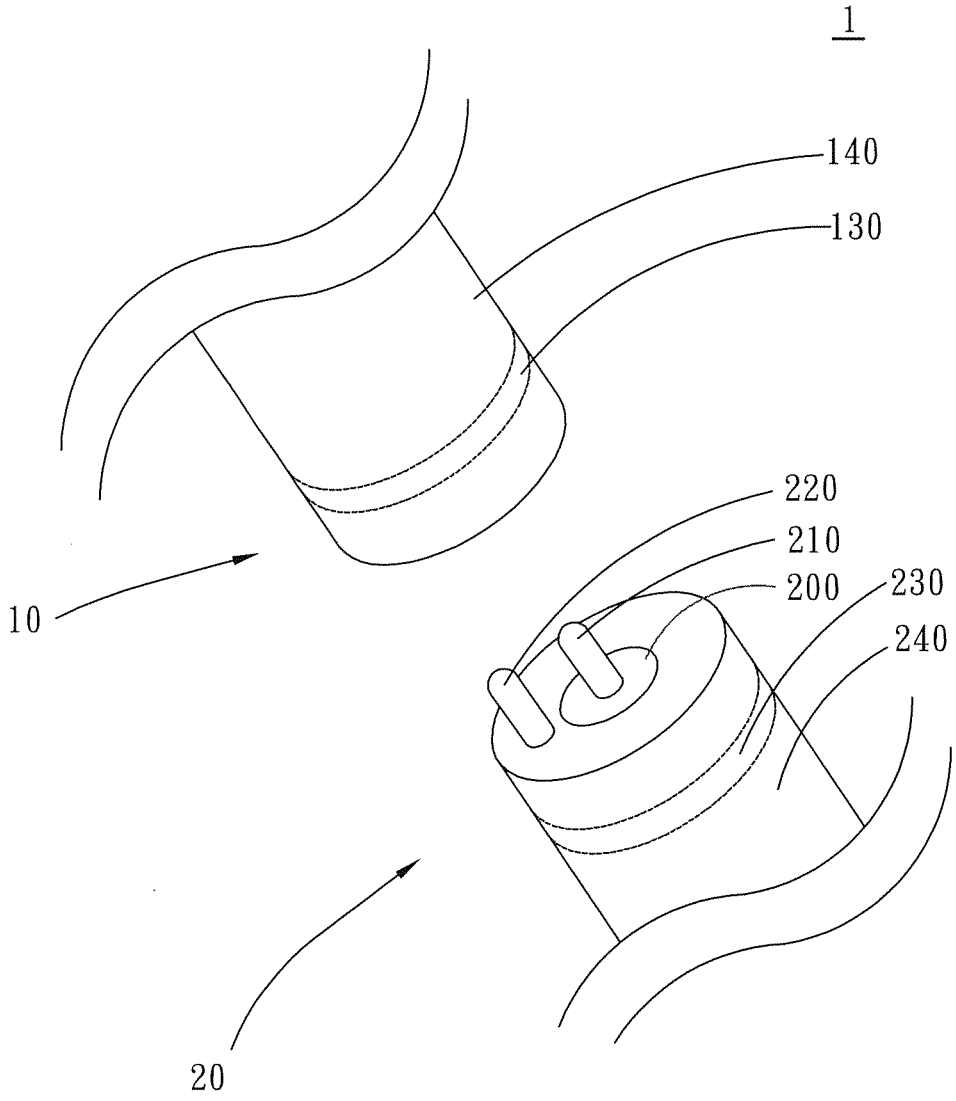
FIG. 1B shows a three-dimensional structural schematic diagram of the magnetic plug according to the present invention.

Please refer to FIG. 1A and FIG. 1B, which show three-dimensional structural schematic diagrams of the magnetic socket and the magnetic plug according to the present invention. As shown in the figures, the main components of the present invention comprise a magnetic socket 10 and a magnetic plug 20. The magnetic socket 10 comprises a positive groove 110, a negative groove 120, and a magnet 130. A first insulation layer 100 is disposed between the positive groove 110 and the negative groove 120. Besides, the magnetic socket 10 is connected electrically with a first member 140. On the other hand, the magnetic plug 20 comprises a positive shaft 210, a negative shaft 220, and an iron member 230. A second insulation layer 200 is disposed between the positive shaft 210 and the negative shaft 220. Besides, the magnetic plug 20 is connected electrically with a second member 240.

The magnetic socket 10 includes the negative groove 120 with the positive groove 110 disposed at the center. The first insulation layer 100 is disposed between the positive groove 110 and the negative groove 120. The negative groove 120 is an annular groove. Furthermore, the magnet 130 is disposed on the other end surface of the magnetic socket 10. The first member 140 is the connected on the magnet 130. The first member 140 is connected electrically from its inside to the inside of the positive groove 110 and the inside of the negative groove 120. In addition, the magnetic plug 20 includes the positive shaft 210 and the negative shaft 220 disposed aside. The second insulation layer 200 is disposed between the positive shaft 210 and the negative shaft 220. The negative shaft 220 is disposed on one side of the positive shaft 210. The iron member 230 is disposed on the other side of the positive and the negative shafts 210, 220. The second member 240 is further disposed on the iron member 230 and connected electrically to the inside of the positive and negative shafts 210, 220.

According to the structure described above, while using the present invention, the positive and negative shafts 210, 220 of the magnetic plug 20 are inserted into and connected electrically with the positive and negative grooves 110, 120. The positive shaft 210 is inserted into and connected electrically with the positive groove 110, while the negative shaft 220 is inserted into and connected electrically with a portion of the negative groove 120. Then the magnet 130 of the magnetic socket 10 and the iron member 230 of the magnetic plug 20 attract each other for securing the electrical connection between the first member 140 of the magnetic socket 10 and the second member 240 of the magnetic plug 20.

Figure 2A:
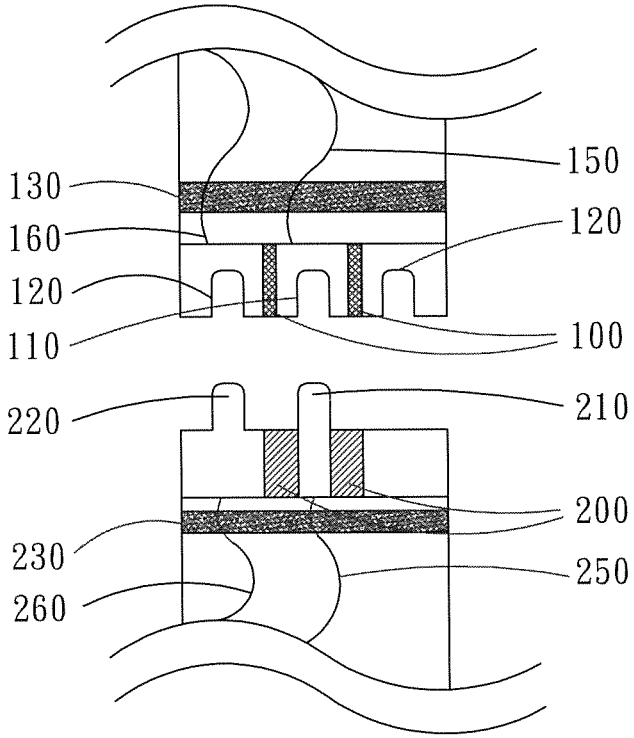
FIG. 2A shows a cross-sectional view of the disassembled magnetic pivot connector according to the present invention.
Figure 2B:
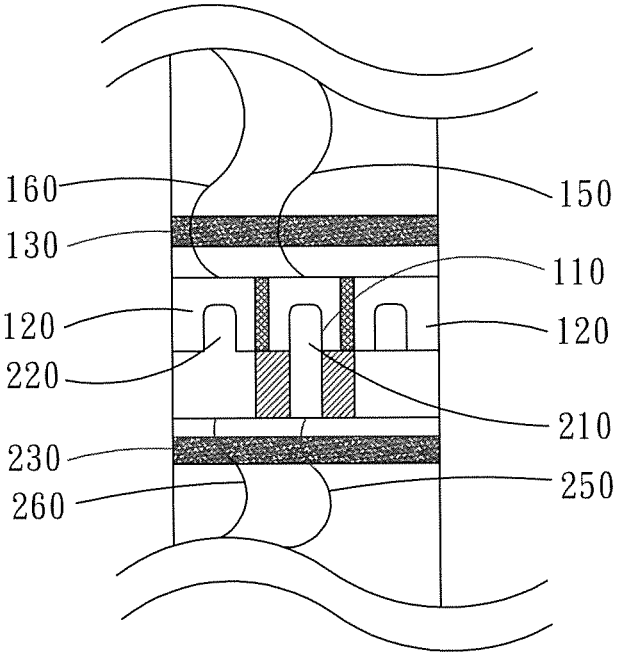
FIG. 2B shows a cross-sectional view of the assembled magnetic pivot connector according to the present invention.

Please refer to FIG. 2A and FIG. 2B, which both show the magnetic pivot connector according to the present invention. As shown in the figures, the electrical connection is that, inside the first member 140, there are a first positive wire 150 and a first negative wire 160. The first positive wire 150 is connected electrically to the positive groove 110 and the first negative wire 160 is connected electrically to the negative groove 120. The positive groove 110 is connected electrically with the positive shaft 210, while the negative groove 120 is connected electrically with the negative shaft 220. The positive shaft 210 and the negative shaft 220 have internal electrical connection with the second member 240. Inside the second member 240, there are a second positive wire 250 and a second negative wire 260. The positive shaft 210 is connected electrically to the second positive wire 250 and the negative shaft 220 is connected electrically to the second negative wire 260 for forming the electrical connection between the first member 140 and the second member 240.

The present invention further makes use of the above structure. In the electrical connection of the magnetic plug 20 and the magnetic socket 10, the positive shaft 210 of the magnetic plug 20 is inserted into the positive groove 110 of the magnetic socket 10; the negative shaft 220 is inserted into the negative groove 120. The positive groove 110 is disposed at the center of the magnetic socket 10. The size of the hole of the positive groove 110 corresponds to the size of the positive shaft 210. Thereby, the positive shaft 210 is wedged in the positive groove 110. On the other hand, the negative groove 120 is an annular groove with a width corresponding to the size of the negative shaft 220. While using, because the positive shaft 210 is wedged in the positive groove 110, the positive shaft 210 can used as the axle center for rotating the magnetic plug 20. The negative shaft 220 moves along the annular groove of the negative groove 120, so that the magnetic plug 20 can make 360-degree rotations. Thereby, the first member 140 connected with the magnetic socket 10 and the second member 240 connected with the magnetic plug 20 can rotate, and thus adjusting the first and second members 140, 240 to the desired angle.

Figure 3A:
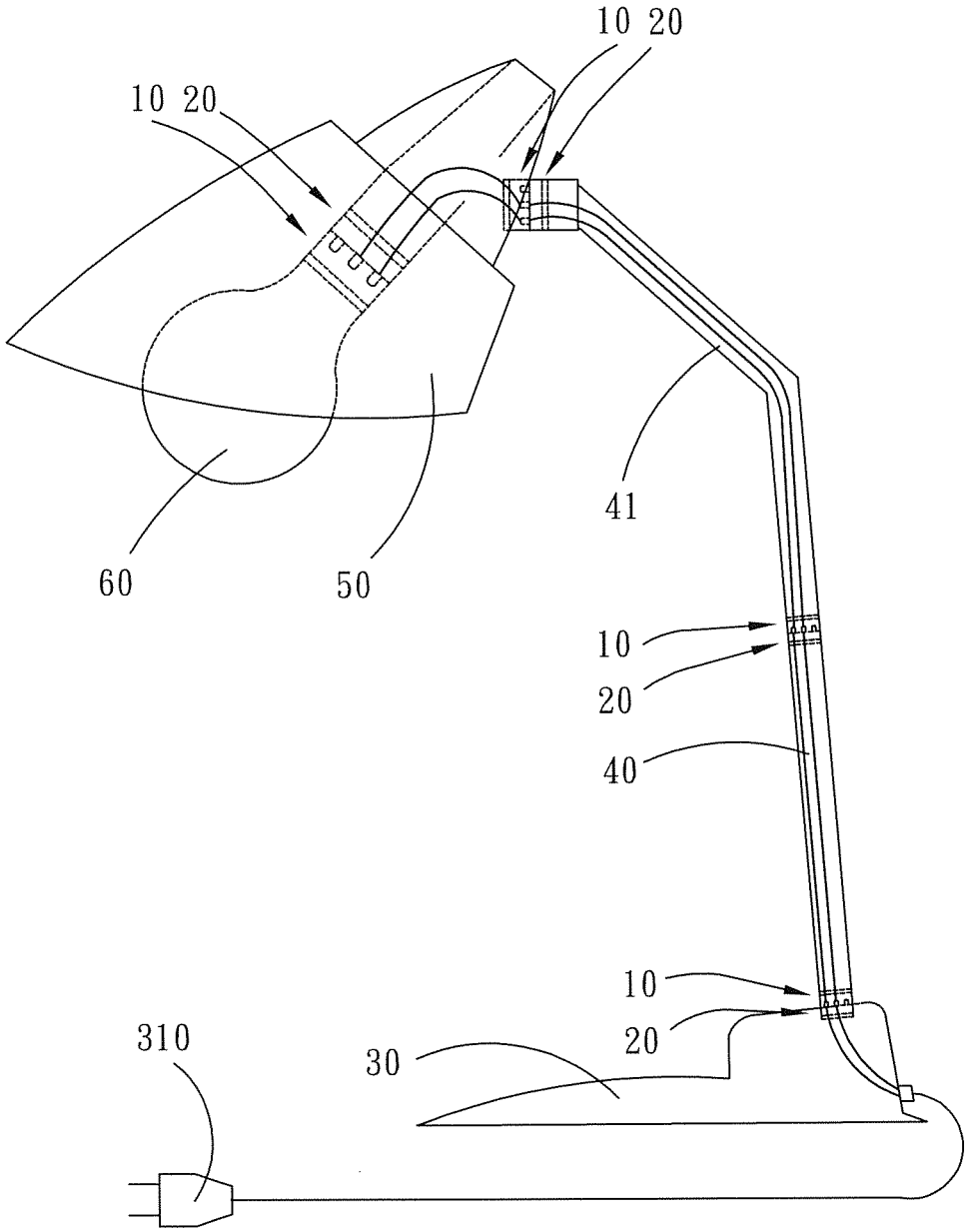
FIG. 3A shows a schematic diagram of the assembled lamp according to the present invention.
Figure 3B:
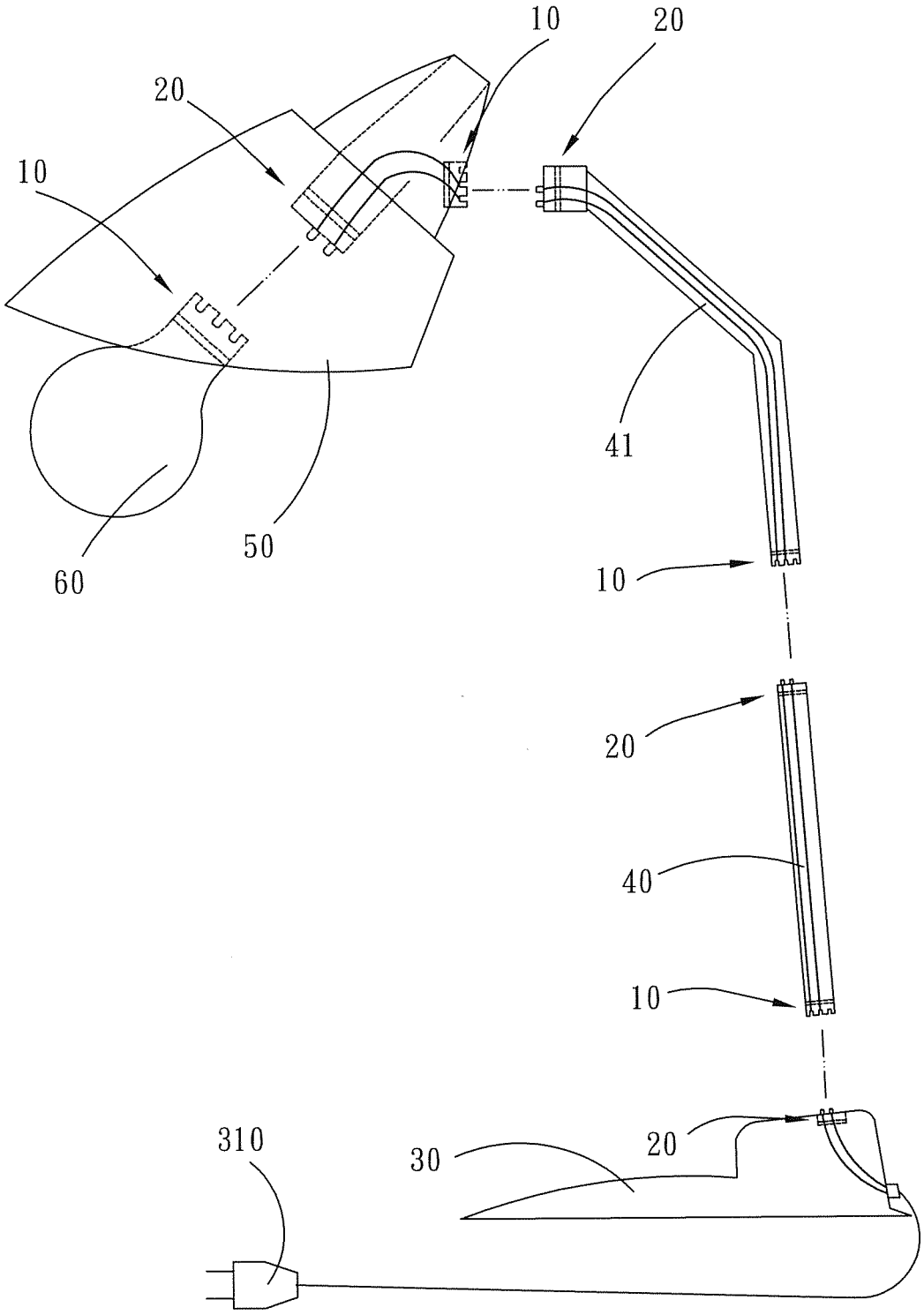
FIG. 3B shows a schematic diagram of the disassembled lamp according to the present invention.

Please refer to FIG. 3A and FIG. 3B, which show schematic diagrams of the assembled and the disassembled lamp according to the present invention. As shown in the figures, a lamp using the magnetic plug 20 and the magnetic socket 10 according to the present invention for assembling is disclosed. One end of a first lamp arm 40 is set as the first member 140; a lamp stand 30 is set as the second member 240. The magnetic plug 20 is disposed on one end of the lamp stand 30, and the inside of the magnetic plug 20 is connected electrically to a power plug 310 on the other end of the lamp stand 30. The magnetic socket 10 is disposed on one end of the first lamp arm 40 and connected electrically to the magnetic plug 20 disposed on the other end of the lamp arm 40 via the inside of the first lamp arm 40. The magnetic socket 10 of the first lamp arm 40 is wedged with the magnetic plug 20 of the lamp stand 30, and thus pivoting and connecting electrically the lamp stand 30 with the first lamp arm 40. In addition, one end of a second lamp arm 41 is set as the first member 140; the other end of the first lamp arm 40 is set as the second member 240. The magnetic socket 10 is disposed on one end of the second lamp arm 41 and connected electrically to the magnetic plug 20 disposed on the other end of the second lamp arm 41 via the inside of the second lamp arm 41. The magnetic plug 20 disposed on the other end of the first lamp arm 40 is pivoted and connected electrically to the magnetic socket 10 of the second lamp arm 41, and thus pivoting and connecting electrically the second lamp arm 41 with the first lamp arm 40. The other end of a second lamp arm 41 is set as the second member 240; one end of a bulb socket 50 is set as the first member 140. The magnetic socket 10 is disposed on one end of the bulb socket 50 and connected electrically to the magnetic plug 20 disposed on the other end of the bulb socket 50 via the inside of the bulb socket 50. The magnetic plug 20 disposed on the other end of the second lamp arm 41 is inserted into and connected electrically to the magnetic socket 10 disposed on one end of the bulb socket 50, and the magnetic plug 20 of the second lamp arm 41 is wedged with the magnetic socket 10 of the bulb socket 50, and thus pivoting and connecting electrically the bulb socket 50 with the second lamp arm 41. Finally, one end of a bulb 60 is set as the first member 140; the other end of the bulb socket 50 is set as the second member 240. The magnetic socket 10 is disposed on one end of the bulb 60 and the magnetic plug 20 is disposed on the other end of the bulb socket 50. The magnetic plug 20 disposed on the other end of the bulb socket 50 is inserted into and connected electrically to the magnetic socket 10 disposed on one end of the bulb 60, wedging the magnetic socket 10 of the bulb 60 with the magnetic plug 20 of the bulb socket 50, and thus pivoting and connecting electrically the second lamp arm 41 with the first lamp arm 40. The structure described above does not limit the disposal relation between the first member 140 and the second member 240; their roles can be exchanged. Both cases make use of plugging and connecting the magnet plug 20 to the magnetic socket 10 for connecting electrically the first member 140 with the second member 240. According to the present invention, the power plug 310 disposed on the other end of the lamp stand 30 is connected to the power source. The electrical power is transferred from the lamp stand 30 to the lamp arm 40, the lamp arm 41, the bulb socket 50, and the bulb 60 sequentially for supplying the power required for lighting the bulb 60.

Figure 4A:
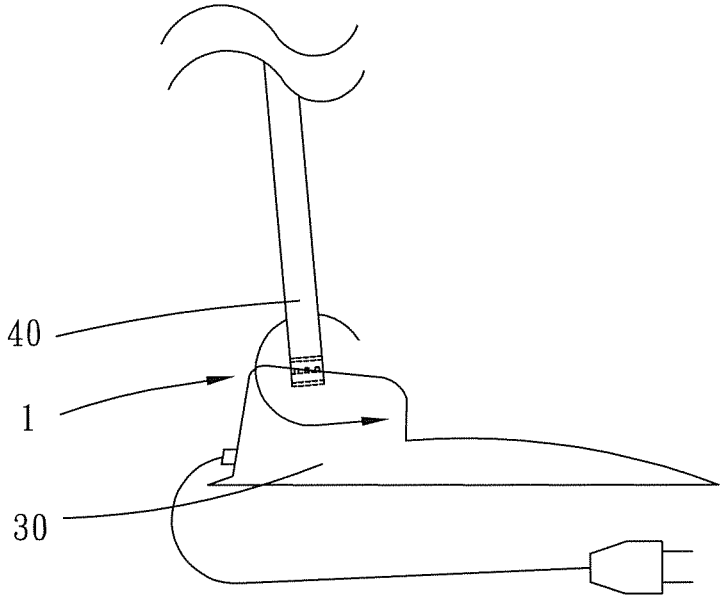
FIG. 4A shows a schematic diagram of the present invention applied to a lamp stand and a lamp arm.

Please refer to FIG. 4A, which shows a schematic diagram of the present invention applied to a lamp stand and a lamp arm. As shown in the figure, the present invention is applied to a table lamp or a floor lamp. The magnetic pivot connector between the lamp stand 30 and the first lamp arm 40 can rotate by 360 degrees. The angle between the lamp stand 30 and the first lamp arm 40 is the one shown in FIG. 3A rotated by 180 degrees. During usage, the lamp stand 30 can be placed at any desired angle.

Figure 4B:
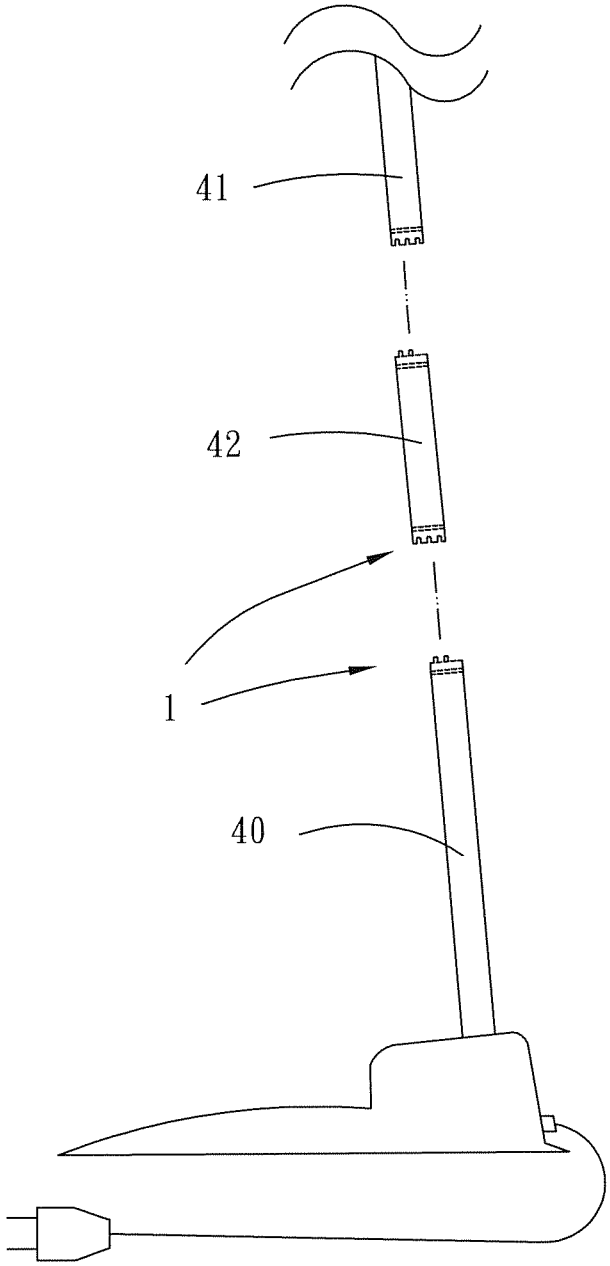
FIG. 4B shows a schematic diagram of the present invention applied to a lamp arm and a lamp arm.

Please refer to FIG. 4B, which shows a schematic diagram of the present invention applied to a lamp arm and a lamp arm. As shown in the figure, the present invention is applied to a table lamp or a floor lamp. A plurality of third lamp arms 42 are further disposed between the first lamp arm 40 and the second lamp arm 41. The magnetic socket 10 is disposed on one end of the third lamp arm 42 while the magnetic plug 20 is disposed on the other end thereof. The magnetic socket 10 and the magnetic plug 10 are connected electrically inside the third lamp arm 42. Thereby, the plurality of third lamp arms 42 can be added and connected electrically for extending the length the lamp arm. Consequently, the illumination location and height by lamps can be set freely.

Figure 4C:
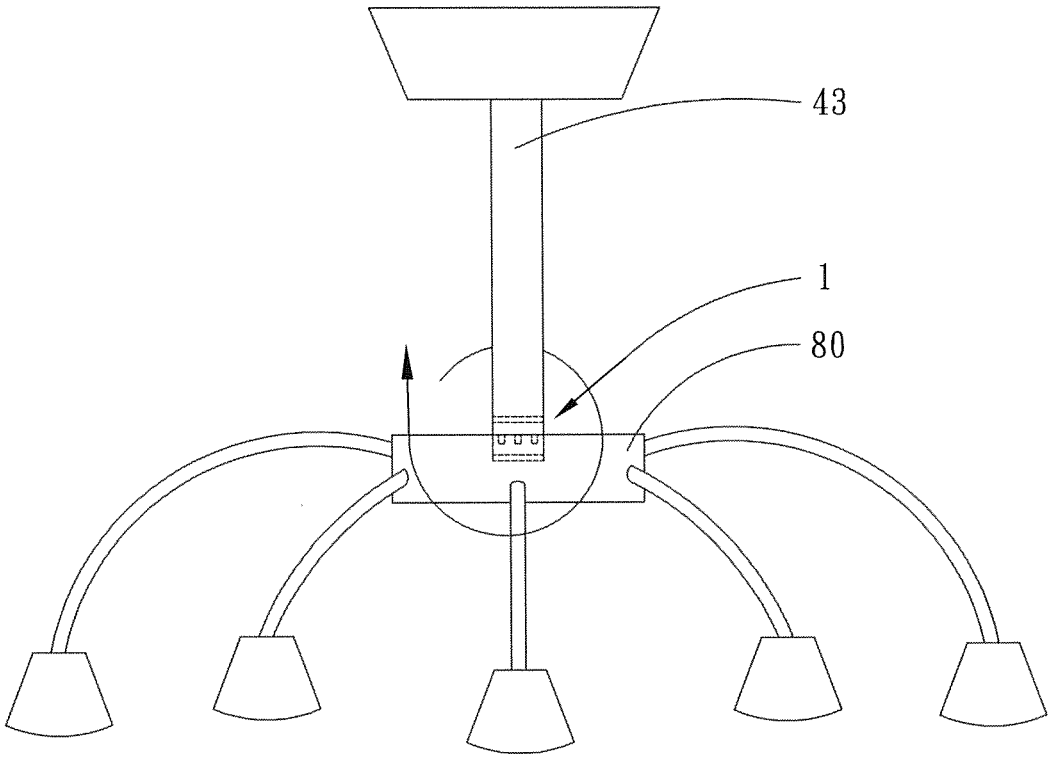
FIG. 4C shows a schematic diagram of the present invention applied to a lamp arm and a lamp head base.

Please refer to FIG. 4C, which shows a schematic diagram of the present invention applied to a lamp arm and a lamp head base. As shown in the figure, the present invention is applied to a pendant lamp. The magnetic pivot connector 1 between a fourth lamp arm 43 and a lamp head base 80 can rotate by 360 degrees. While using, the bulb sockets 50 for any desired illumination angle can be disposed.

Figure 4D:
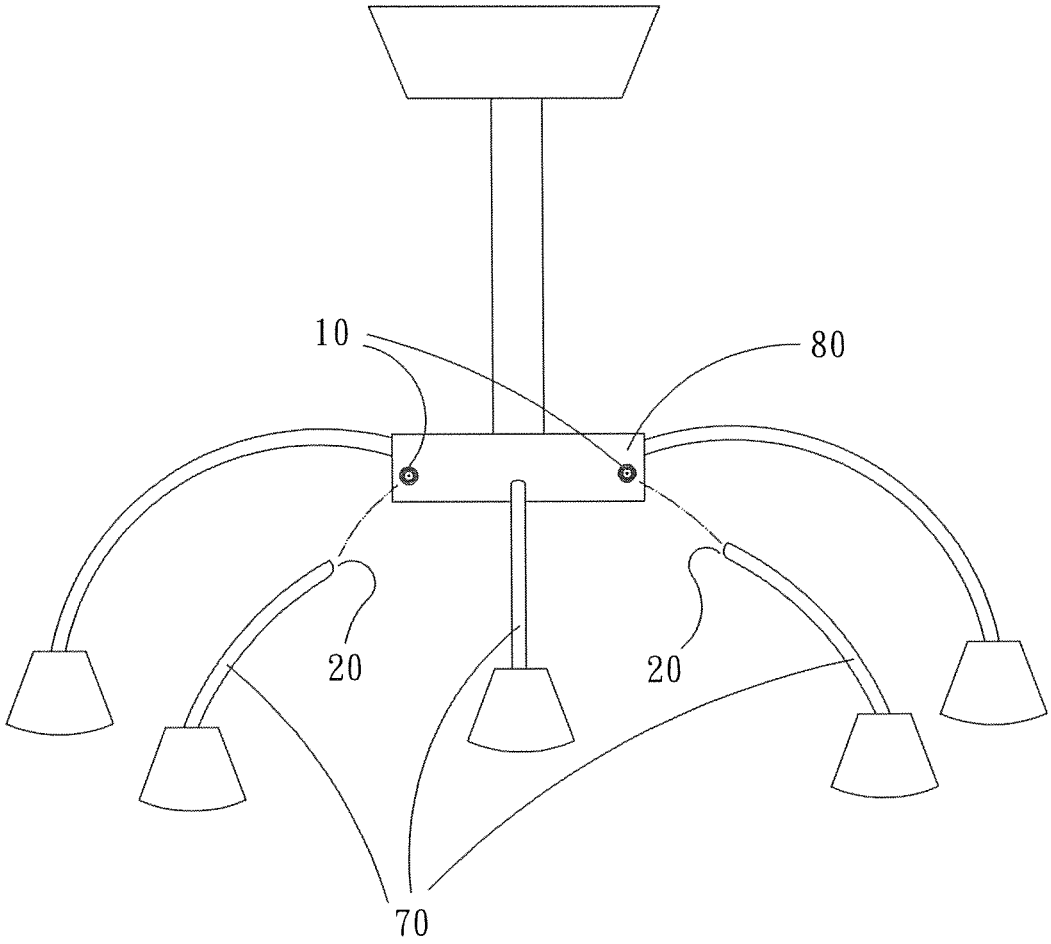
FIG. 4D shows a schematic diagram of the present invention applied to a lamp head base and connecting arms for pendant lamp.
Figure 4E:
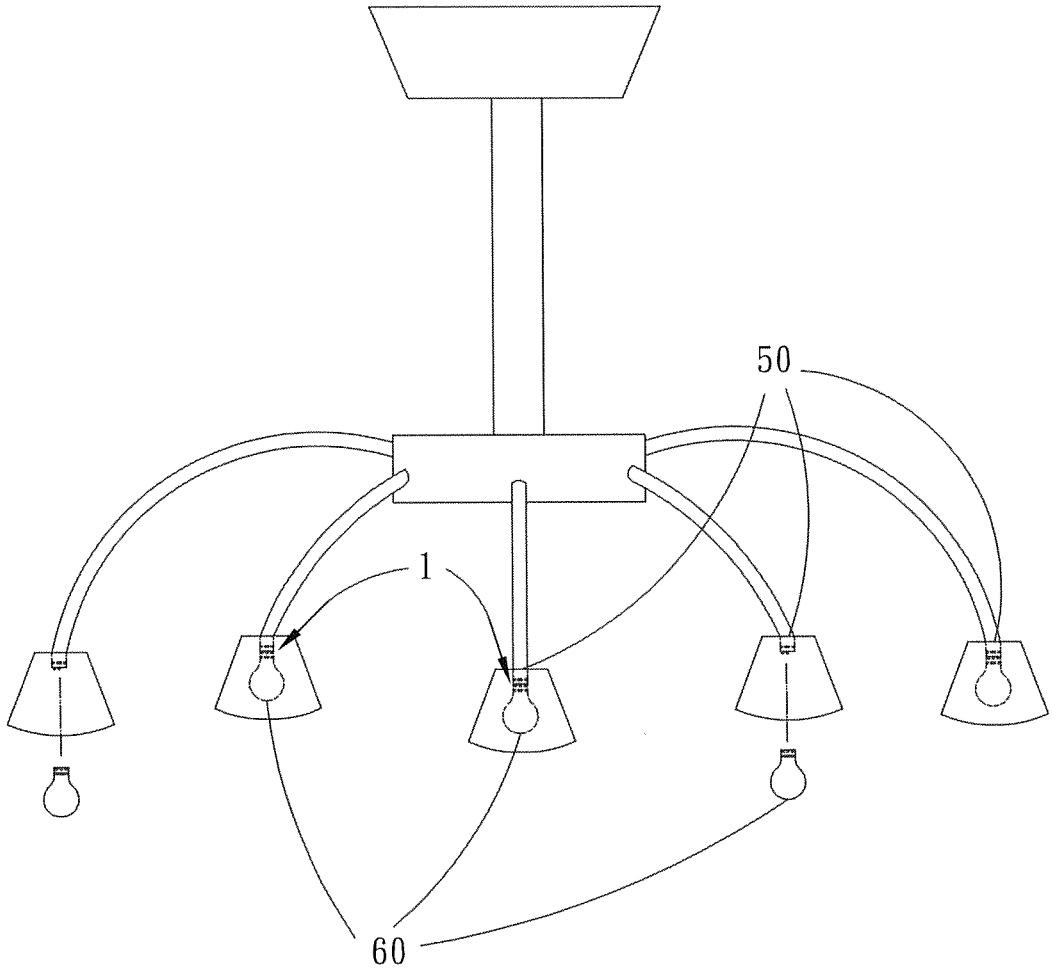
FIG. 4E shows a schematic diagram of the present invention applied to bulb sockets and bulbs.

Please refer to FIG. 4D and FIG. 4E, which show schematic diagrams of the present invention applied to bulb sockets and bulbs. As shown in the figures, the present invention is applied to a pendant lamp. By using the lamp head base 80 according to the present invention, a plurality of magnetic sockets 10 are disposed on the structure of the pendant lamp. A magnetic plug 20 is disposed on one end of a plurality of connecting arms for the pendant lamp 70. According to the required quantity, the connecting arms for the pendant lamp 70 are connected to the lamp head base 80. Alternatively, a plurality of magnetic plugs 20 are disposed on the other end of the bulb sockets 50. The magnetic sockets 20 corresponding to the other end of the bulb sockets 50 are disposed on the electrical connection end of the bulbs 60. By using magnetic attraction, the bulbs 60 and the bulb sockets 50 can be connected easily. During usage, the quantity of the bulbs 60 and the connecting arms for pendant lamp 70 can be adjusted according to the required brightness for saving power.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. A magnetic pivot connector for lamp, comprising:

a magnetic socket, having a negative groove and a positive groove disposed at the center, having a first insulation layer disposed between said positive groove and said negative groove, having a magnet disposed on one side of said positive groove and said negative groove, and said positive groove and said negative groove connected electrically to a first member; and a magnetic plug, comprising a positive shaft and a negative shaft disposed beside said positive shaft, having a second insulation layer disposed between said positive shaft and said negative shaft, having an iron member disposed on one side of said positive shaft and said negative shaft, and said positive shaft and said negative shaft connected electrically to a second member;

where when said positive shaft is inserted into and connected to said positive groove and said negative shaft is inserted into and connected to said negative groove, said magnet attracts said iron member and thus connecting electrically said first member with said second member; and said positive shaft is used as the axle center and said negative shaft rotates around said negative groove, so that said first member and said second member are connected pivotally and rotate with respect to each other for assembling the lamp.

2. The magnetic pivot connector for lamp of claim 1, wherein said first member is a first lamp arm and said second member is a lamp stand.

3. The magnetic pivot connector for lamp of claim 1, wherein said first member is a first lamp arm and said second member is a second lamp arm.

4. The magnetic pivot connector for lamp of claim 3, wherein a plurality of third lam arms are further disposed between said first lamp arm and said second lamp arm.

5. The magnetic pivot connector for lamp of claim 1, wherein said first member is a first lamp arm and said second member is a bulb socket.

6. The magnetic pivot connector for lamp of claim 1, wherein said first member is a bulb arm and said second member is a bulb socket.

7. The magnetic pivot connector for lamp of claim 1, wherein said first member is a lamp head base and said second member is a connecting arm for pendant lamp.

8. The magnetic pivot connector for lamp of claim 1, wherein said first member is a fourth lamp arm and said second member is a lamp head base with a plurality of magnetic sockets.

* * * * *